US006775923B2

(12) United States Patent
Do

(10) Patent No.: US 6,775,923 B2
(45) Date of Patent: Aug. 17, 2004

(54) LAUNDRY DRIER CONTROL METHOD

(75) Inventor: Gi Hyeong Do, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/717,611

(22) Filed: Nov. 21, 2003

(65) Prior Publication Data

US 2004/0103555 A1 Jun. 3, 2004

(30) Foreign Application Priority Data

Nov. 26, 2002 (KR) ..... 10-2002-0074062

(51) Int. Cl.[7] ..... F26B 3/00

(52) U.S. Cl. ..... 34/527; 34/524; 34/526; 34/562; 34/596

(58) Field of Search ..... 34/486, 491, 493, 34/495, 496, 524, 526, 527, 549, 553, 596, 562, 202; 219/492

(56) References Cited

U.S. PATENT DOCUMENTS 4,397,101 A * 8/1983 Rickard ..... 34/495
4,412,389 A * 11/1983 Kruger ..... 34/535
4,788,775 A * 12/1988 Ahmed ..... 34/562
5,193,292 A * 3/1993 Hart et al. ..... 34/527
6,700,102 B2 * 3/2004 St. Louis ..... 34/524

* cited by examiner

*Primary Examiner*—Jiping Lu
(74) *Attorney, Agent, or Firm*—McKenna Long & Aldridge LLP

(57) ABSTRACT

A laundry drier control method is provided, by which drying time is dynamically controlled according to an amount and type of a drying object, using a calculated medium temperature to determine a medium temperature time. The method includes steps of initiating a drying procedure by actuating drivers, including a heater driver to increase an internal temperature of a laundry drier; determining a medium temperature time by measuring a time lapse from the drying procedure initiating step to a point where the internal temperature reaches a medium temperature between a drying initiation temperature and a maximum drying temperature; setting a drying time based on the determined medium temperature time; and performing the drying procedure for the set drying time. The drying time is set by multiplying the determined medium temperature time by a predetermined factor. The drying initiation temperature is the internal temperature at the time of initiating the drying procedure. The maximum drying temperature is a predetermined temperature set according to a user command at the time of initiating the drying procedure.

11 Claims, 5 Drawing Sheets

LAUNDRY DRIER CONTROL METHOD

This application claims the benefit of Korean Application No. 10-2002-0074062 filed on Month 26, 2002, which is hereby incorporated by reference.

BACKGROUND OF THE INVENTION

1. Field of the Invention

The present invention relates to a laundry drier, and more particularly, to a laundry drier control method in which a medium temperature is calculated so that drying time may be dynamically controlled.

2. Discussion of the Related Art

A laundry drier is an apparatus for drying wet objects, e.g., clothes, after completion of a washing cycle or the like. FIGS. 1 and 2 illustrate a laundry drier according to a related art, with FIG. 2 showing a cross-section taken along a line I—I in FIG. 1.

Referring to FIGS. 1 and 2, a drier according to a related art is comprised of a body 100 having an entrance 101 at a front side in which a door 105 is installed, a drum 30 rotatably installed in the body and having a plurality of stirrers 30*a* protruding from an inner circumferential surface of the drum, a motor 50 fixed to an inner side surface of the body to generate and transfer via a belt 60 a slow and directionally controllable rotational force with respect to the drum, first and second hot air passages 10*a* and 10*b* for guiding an air flow of external air (10*a*) to drum's interior to be discharged (10*b*) to the exterior of the laundry drier, a heater 20 installed inside the first hot air passage to heat the air therein, and an exhaust fan 40 for generating a forcible blowing force to discharge air through the second hot air passage and thereby draw in external air through the first hot air passage.

Referring to FIG. 3, illustrating a laundry drying method according to the related art, with wet laundry placed in the drum 30, drying is initiated in a step S10 to actuate each of the exhaust fan 40, the heater 20, and the motor 50. As the exhaust fan 40 starts to operate, external air is drawn in through the first hot air passage 10*a*, where it is heated by passing through the heater 20 and forcibly led into the drum 30, to evaporate the water content of laundry placed therein. Thus, the drying action is realized by a negative blowing force of the exhaust fan 40, whereby a circulation of air is achieved by drawing in external air through the first hot air passage 10*a* and discharging the air through the second hot air guide passage 10*b*. Meanwhile, the drum 30 is rotated according to a predetermined cycle, and the stirrers 30*a* pull the laundry up one side of the drum's interior to fall back down into a lower area thereof. The laundry is dried in a step S20 through the above-explained process.

As drying thus proceeds, if it is determined in a step S30 that a predetermined time has passed, the heater 20 and motor 50 are stopped in a step S40. Here, the exhaust fan 40 continues to operate for a fixed predetermined time of say, five minutes, to perform a cooling of the interior of the laundry drier in a step S50, after which the door 105 may be opened. Thus, the cooling is performed according to a procedure similar to that of the steps S20–S40 in which a constant operation is continued for a fixed duration.

As above, the laundry drier of the related art completes its assigned task by execution according to a predetermined time. That is, the drying procedure is performed for a fixed time, as set by the manufacturer, regardless of the amount or type of laundry being dried. Therefore, drying may be incomplete or excessive.

SUMMARY OF THE INVENTION

Accordingly, the present invention is directed to a laundry drier control method that substantially obviates one or more of the problems due to limitations and disadvantages of the related art.

An object of the present invention, which has been devised to solve the foregoing problem, lies in providing a laundry drier control method, by which drying time is dynamically controlled according to an amount and type of a drying object.

It is another object of the present invention to provide a laundry drier control method, by which drying is performed accurately according to the amount and type of object being dried.

It is another object of the present invention to provide a laundry drier control method, by which a proper drying is determined according to the amount and type of object being dried.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a laundry drier control method. The method comprises steps of initiating a drying procedure by actuating a plurality of drivers, including a heater driver to increase an internal temperature of a laundry drier; determining a medium temperature time by measuring a time lapse from the drying procedure initiating step to a point where the internal temperature reaches a medium temperature between a drying initiation temperature and a maximum drying temperature; setting a drying time based on the determined medium temperature time; and performing the drying procedure for the set drying time.

In the above method of the present invention, the drying time is set by multiplying the determined medium temperature time by a predetermined factor, the drying initiation temperature is the internal temperature at the time of initiating the drying procedure, and the maximum drying temperature is a predetermined temperature set according to a user command at the time of initiating the drying procedure.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

A laundry drier control method according to the present invention uses the rate of temperature rising in a drying procedure to enable a dynamic control of drying time according to an amount and type of a drying object, i.e., laundry, inside a laundry drier adopting the method. The drying time is determined by first measuring the time required for a medium temperature to be reached, hereinafter referred to as the medium temperature time, which is determined by measuring a time lapse from an initiation of the drying procedure to a point where the internal temperature reaches the medium temperature. The medium temperature is calculated by finding the halfway point between a drying initiation temperature is and a maximum drying temperature, wherein the drying initiation temperature is the drier's internal temperature (typically at or near room ambient) at the time of initiating a drying procedure and wherein the maximum drying temperature is set according to a user command. Once the medium temperature is calculated and the medium temperature time is determined, the drying time is calculated by multiplying the medium temperature time by a predetermined multiplying factor, to determine the remaining drying time. Thus, drying time can be dynamically controlled according to an amount and type of laundry inside the laundry drier.

Figure 1:
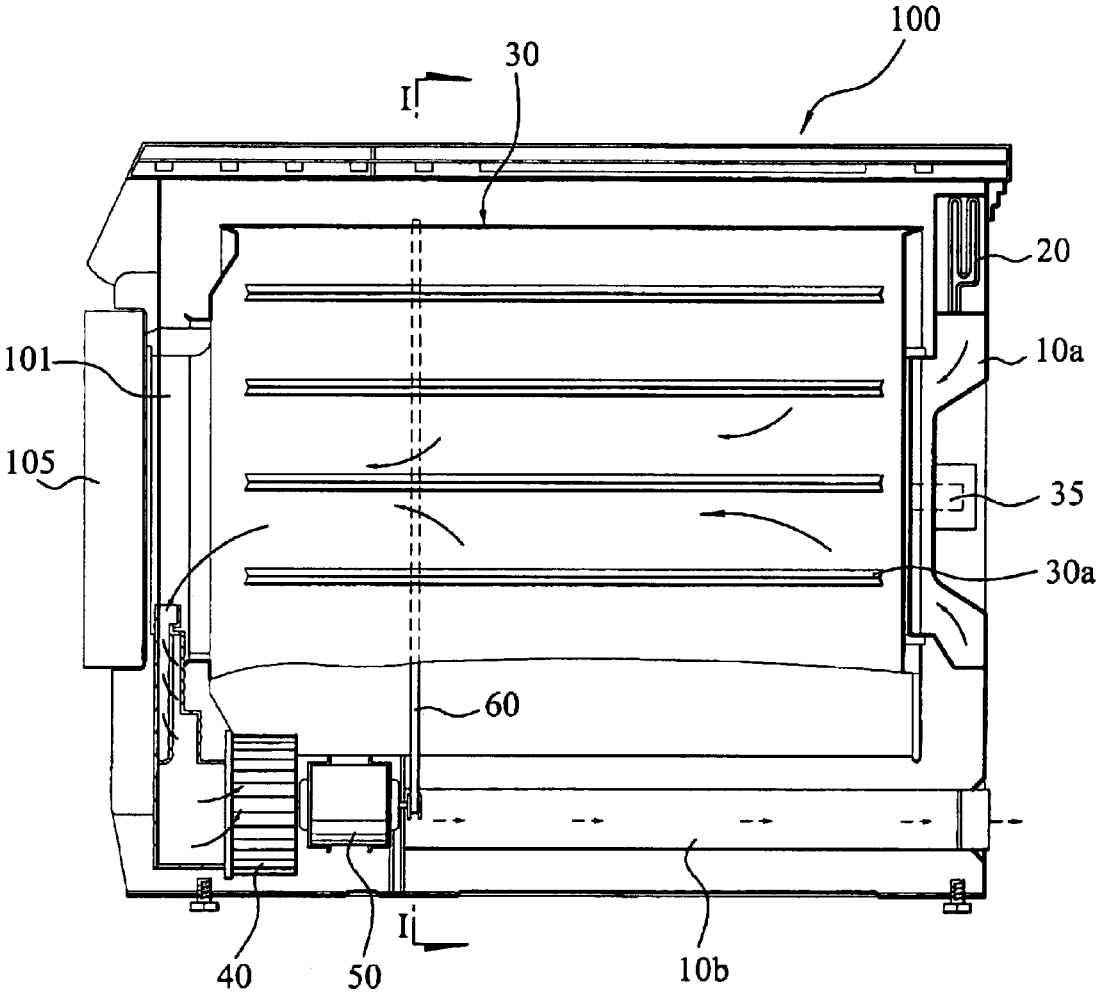
FIG. 1 Related Art
FIG. 1 is a cross-sectional view of a laundry drier according to a related art.
Figure 2:
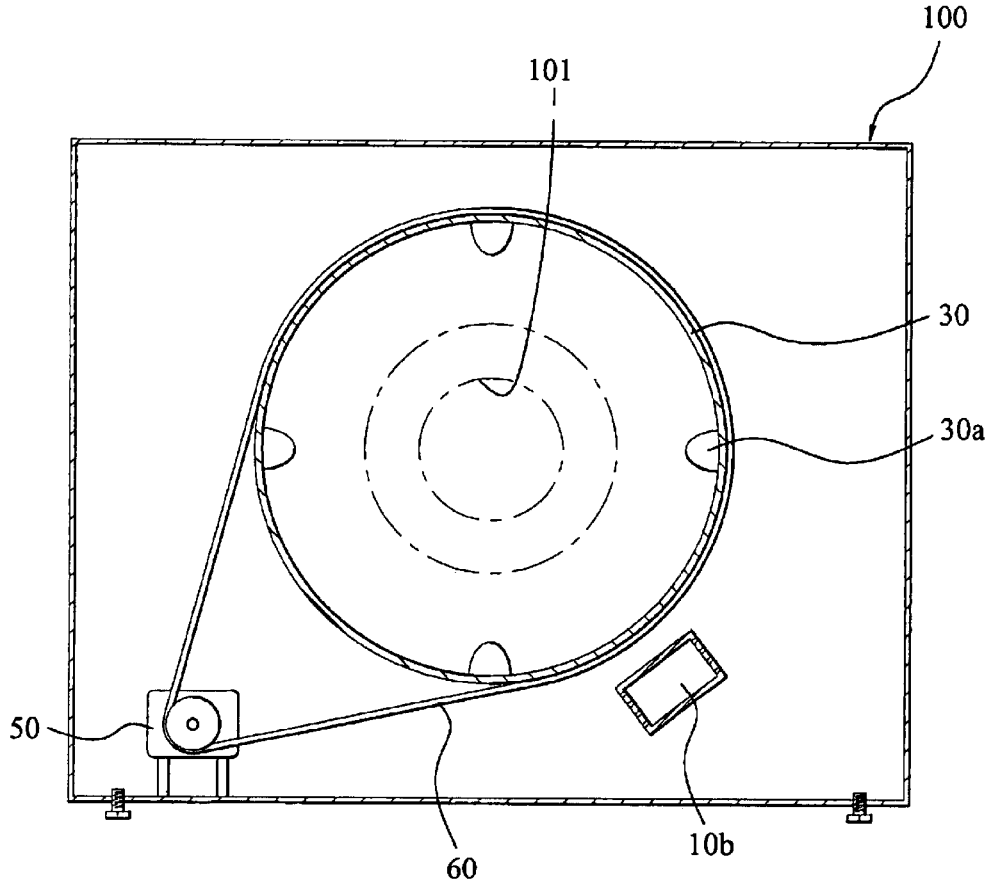
FIG. 2 Related Art
FIG. 2 is a cross-sectional view along a line I—I in FIG. 1.
Figure 3:
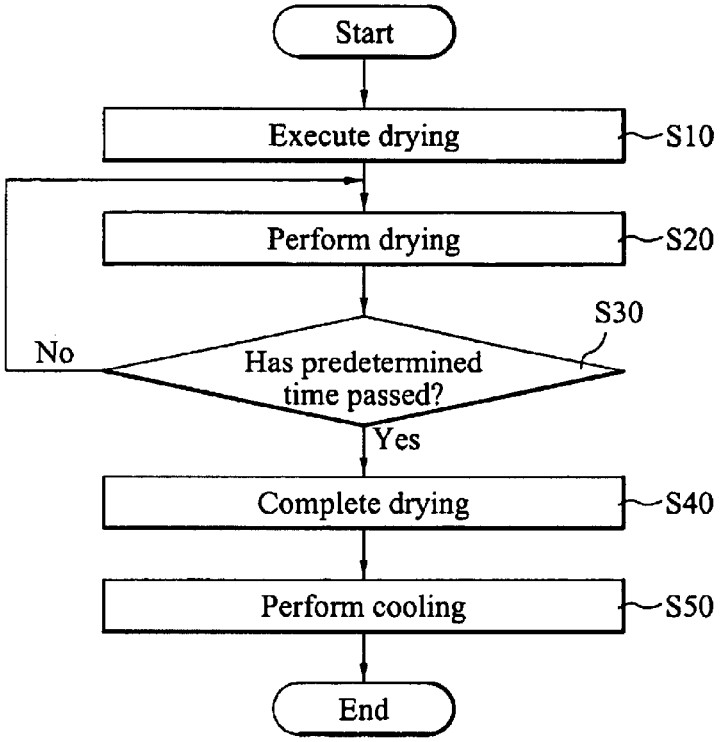
FIG. 3 Related Art
FIG. 3 is a flow chart of a laundry drying control method according to a related art.
Figure 4:
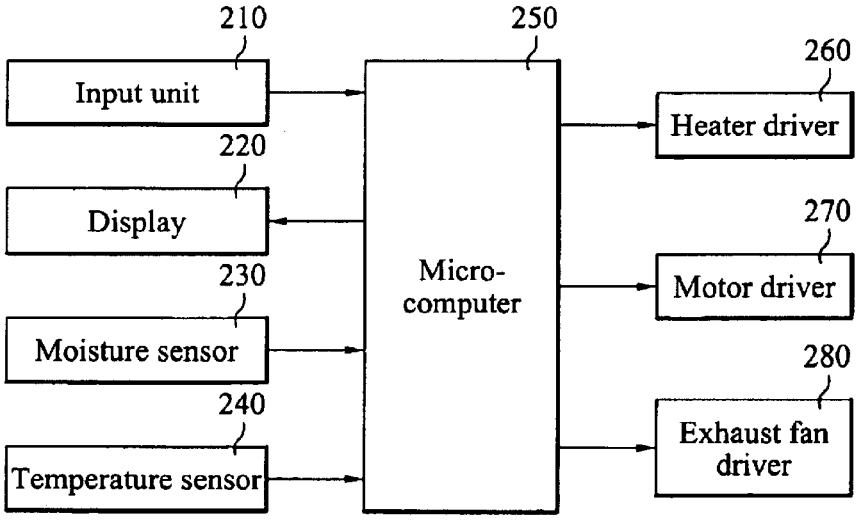
FIG. 4 is a block diagram of a laundry drier adopting the method according to the present invention.

Referring to FIG. 4, a laundry drier adopting the control method according to the present invention is comprised of an input unit 210 for inputting user commands, a display 220 for displaying the respective operational states of drying and cooling procedures based on the input user commands, a moisture sensor 230 for measuring the water content of laundry during the drying procedure and for outputting a sensed water content signal, a temperature sensor 240 for detecting an internal temperature during the drying and cooling procedures and for outputting a sensed temperature signal, a microcomputer 250 for controlling the drying and cooling procedures based on the sensed signals and user command input, to determine the state of the drying procedure and to control accordingly each of heater, motor, and exhaust fan drivers 260, 270, and 280.

Figure 5:
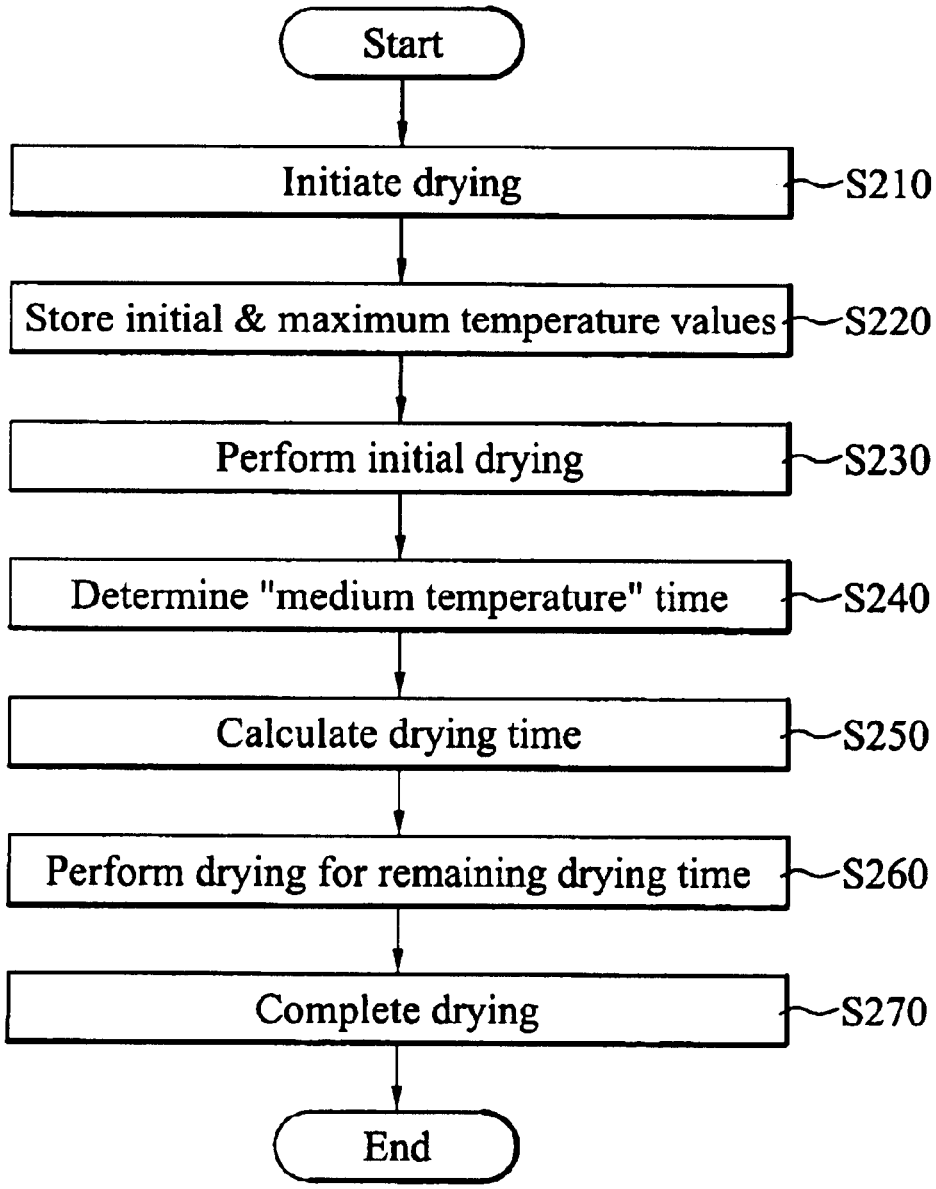
FIG. 5 is a flowchart of a laundry drier control method according to the present invention.

Referring to FIG. 5, illustrating a laundry drier control method according to the present invention, with a drying object (laundry) placed inside a laundry drier, the user manipulates the input unit 210 to actuate the heater, motor, and exhaust fan drivers 260, 270, and 280 and thereby initiate a drying procedure in a step S210. Upon initiation of the drying procedure, the microcomputer 250 stores in a step S220 values respectively indicative of the drying initiation temperature and the maximum drying temperature, and initial drying is performed in a step S230. That is, the moment the drying procedure is initiated, the temperature sensor 240 measures the internal temperature of the laundry drier, which is stored in the microcomputer 250 as a drying initiation temperature value. At the same time, the user manipulation of the input unit 210 sets a predetermined temperature as the maximum drying temperature, which is stored in the microcomputer 250 as a maximum drying temperature value. The initial drying proceeds while the internal temperature is monitored.

As the drying proceeds, the time required for reaching the medium temperature between the drying initiation temperature and the predetermined maximum drying temperature is measured. Thus, the medium temperature time is determined in a step S240 by calculating the halfway point between the drying initiation and maximum drying temperatures and then measuring the elapsed time from the initiation of the drying procedure to the point where the medium temperature is reached. Thereafter, the drying time is calculated in a step 250, and drying continues in a step 260 for the remaining drying time, i.e., the calculated time minus the medium temperature time. The drying time calculation is performed by multiplying the medium temperature time by a predetermined factor, which can be set as a constant value. The predetermined multiplying factor is preferably ten. The drying procedure is then completed in a step S270, upon which time at least the operation of the heater driver 260 is stopped and a cooling procedure is initiated. Finally, the microcomputer 250 controls the display 220 to display a "drying complete" message for recognition by the user.

Figure 6:
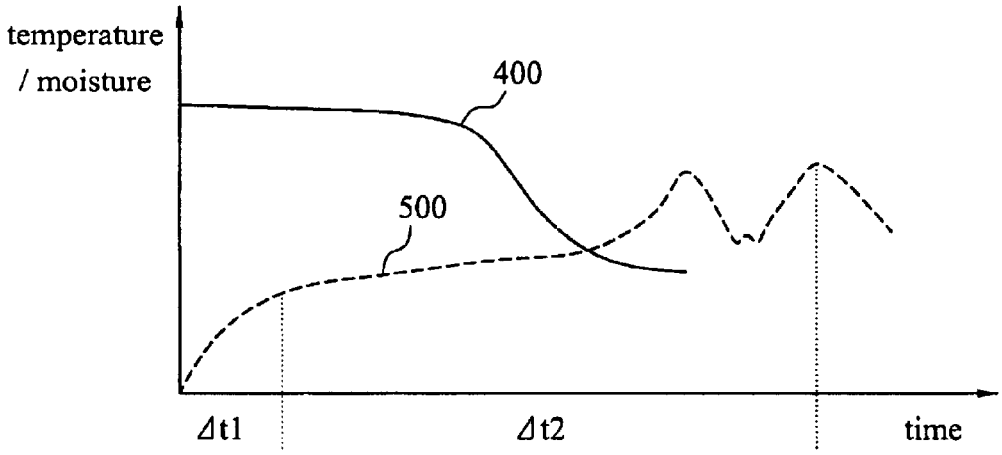
FIG. 6 is a graph showing sample moisture and temperature curves according to time in a laundry drier adopting the method of the present invention.

Upon initiation of the drying procedure in the above laundry drier control method of the present invention, the moisture and temperature sensors 230 and 240 begin sending respective readings to the microcomputer 250 according to the drying time. As shown in FIG. 6, curves 400 and 500 show sample moisture and temperature variations, respectively, wherein a sharp rise in temperature can be seen following a substantial drop in moisture.

Referring to the example of FIG. 6 and assuming a maximum drying temperature set at 70° and a drying initiation temperature of 20° (room ambient), a medium temperature time $\Delta t1$ is required for the medium temperature (45°) to be reached. The time $\Delta t1$ is then multiplied by a predetermined factor, e.g., ten, and the resulting product determines a remaining drying time $\Delta t2$ for which the drying procedure continues.

As described above, a laundry drier control method according to the present invention enables a dynamic control of drying time according to an amount and type of laundry inside a laundry drier. Hence, the overall drying time can be dynamically controlled, to differentiate the drying time according to the amount and type of laundry put in the drier. Thus, an improved operation of a laundry drier is achieved by determining a proper drying time whereby drying time is reduced when the drying object (laundry load) is small or can be dried quickly and is increased for larger loads or loads that may take longer to dry.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry drier control method comprising steps of:

initiating a drying procedure by actuating a plurality of drivers, including a heater driver to increase an internal temperature of a laundry drier;

determining a medium temperature time by measuring a time lapse from said drying procedure initiating step to a point where the internal temperature reaches a medium temperature between a drying initiation temperature and a maximum drying temperature;

setting a drying time based on the determined medium temperature time; and performing the drying procedure for the set drying time.

2. The method as claimed in claim 1, wherein the drying time is set by multiplying the determined medium temperature time by a predetermined factor.

3. The method as claimed in claim 2, wherein the predetermined factor is ten.

4. The method as claimed in claim 2, wherein the predetermined factor is a constant.

5. The method as claimed in claim 1, wherein the drying initiation temperature is the internal temperature at the time of initiating the drying procedure.

6. The method as claimed in claim 5, wherein the internal temperature at the time of initiating the drying procedure is substantially a room ambient temperature.

7. The method as claimed in claim 1, wherein the maximum drying temperature is a predetermined temperature set according to a user command at the time of initiating the drying procedure.

8. The method as claimed in claim 7, wherein the predetermined temperature is set according to an amount and type of a drying object.

9. The method as claimed in claim 1, further comprising a step of storing in a memory values indicative of the drying initiation temperature and the maximum drying temperature.

10. The method as claimed in claim 1, further comprising a step of stopping the heater driver after completion of the drying procedure.

11. The method as claimed in claim 1, further comprising a step of displaying a drying complete status after completion of the drying procedure.

* * * * *